US006643964B1

(12) United States Patent
Stern

(10) Patent No.: US 6,643,964 B1
(45) Date of Patent: Nov. 11, 2003

(54) HANGER FOR A LEVER-TYPE DOOR HANDLE AND METHOD OF USE

(76) Inventor: Daniel A. Stern, 941 N. Norman Pl., Los Angeles, CA (US) 90049

( * ) Notice: Subject to any disclaimer, the term of this patent is extended or adjusted under 35 U.S.C. 154(b) by 0 days.

(21) Appl. No.: 10/082,529

(22) Filed: Mar. 1, 2002

(51) Int. Cl.[7] ..... G09F 23/00
(52) U.S. Cl. ..... 40/599; 40/331
(58) Field of Search ..... 40/599, 331, 332, 40/310; D20/42

(56) References Cited

U.S. PATENT DOCUMENTS 1,536,445 A * 5/1925 Maupai ..... 40/310
1,853,622 A * 4/1932 Kennedy ..... 40/331
2,222,166 A * 11/1940 Beline ..... 40/331
2,340,719 A * 2/1944 Walter ..... 40/310
3,831,300 A * 8/1974 Berkhouse ..... 40/310
4,545,521 A * 10/1985 Hiersteiner ..... 40/331 X
D316,877 S * 5/1991 Mitchell ..... D20/43
D415,526 S * 10/1999 Ho ..... D20/42 X
6,219,949 B1 * 4/2001 Pang ..... 40/599
6,385,874 B1 * 5/2002 Tsonas ..... 40/310 X

* cited by examiner

*Primary Examiner*—Joanne Silbermann
(74) *Attorney, Agent, or Firm*—Ted Masters

(57) ABSTRACT

A hanger for a lever-type door handle is constructed such that the hanger will not fall off of the handle when the door is opened and closed. The hanger has a first section having a first hole and a second section having a second hole. The first and second sections are resiliently biased apart so that when they receive the shank portion of the door handle, the hanger is held firmly in place upon the door handle.

4 Claims, 10 Drawing Sheets

Fig. 1
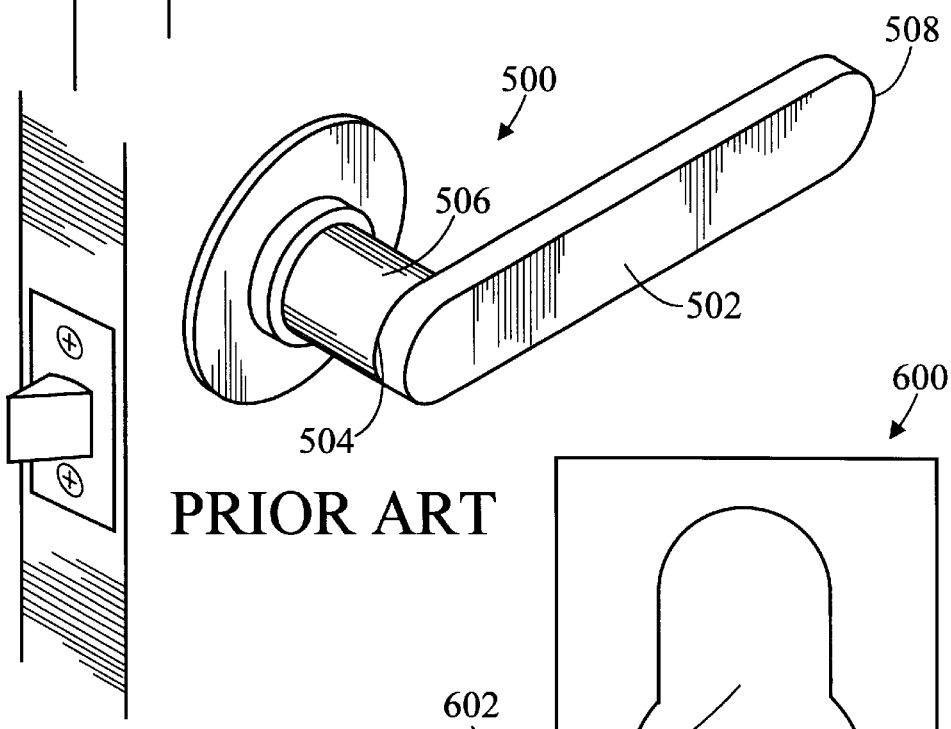
PRIOR ART
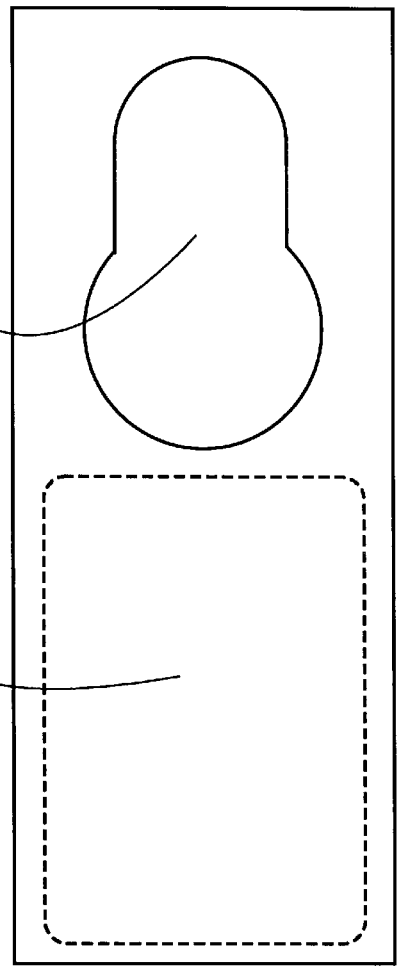
Fig. 2
PRIOR ART

Fig. 5
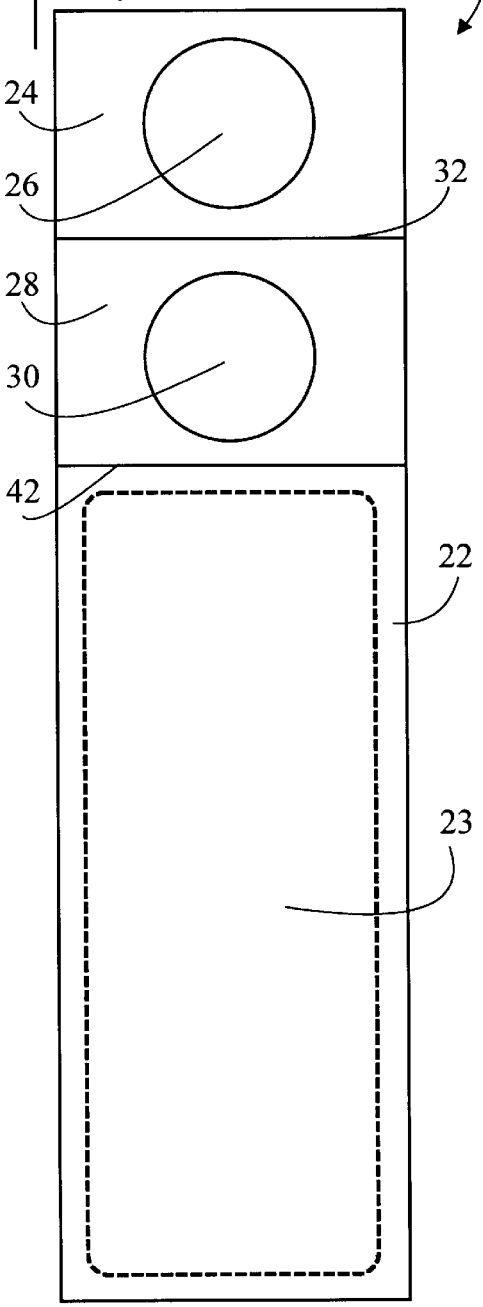
Fig. 6
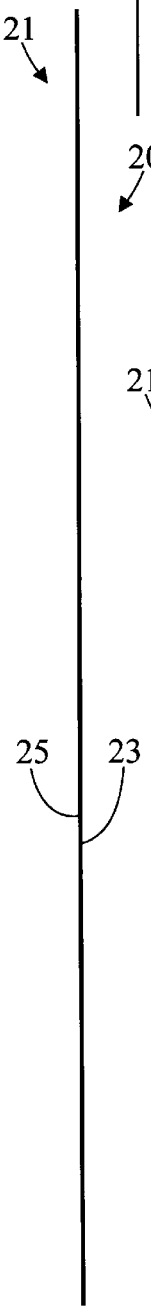
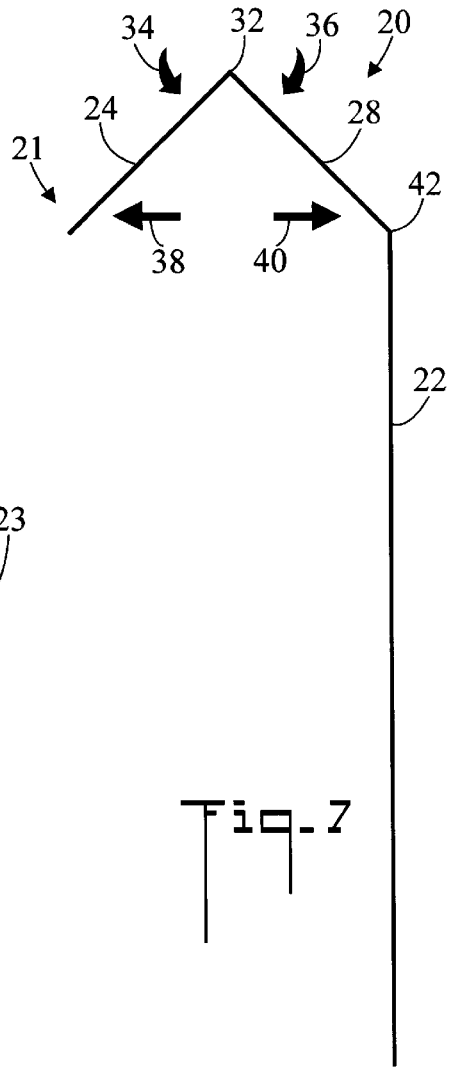
Fig. 7

HANGER FOR A LEVER-TYPE DOOR HANDLE AND METHOD OF USE

TECHNICAL FIELD

The present invention pertains generally to hangers which are placed upon the handle of a door to convey information, and more particularly to a hanger which will not fall off of a lever-type door handle when the door is opened and closed.

BACKGROUND OF THE INVENTION

Hangers are often utilized to convey information or give instructions by placing the hanger upon the handle of a door. For example, in a boarding establishment such as a hotel, motel, rooming house, bed and breakfast, or the like, hangers are used by customers to give instructions to the cleaning staff. The hanger is placed upon the outside door handle of their room. One side of the handle might contain DO NOT DISTURB and the other side might contain PLEASE CLEAN ROOM.

A problem exists however with lever-type door handles (commonly referred to as European door handles). Because of their construction, hangers can easily fall off of the door handle when the door is opened or closed. The present invention is directed toward the solution of this problem.

SUMMARY OF THE INVENTION

The present invention is directed to a hanger for a lever-type door handle which once installed upon the door handle is self locking and therefore will not dislodge when the door is opened and closed. The present invention employs a unique three dimensional structure which locks the hanger upon the shank portion of the door handle.

In accordance with a preferred embodiment of the invention, a hanger for a lever-type door handle having a lever portion connected to a substantially perpendicular shank portion, includes a body having a first section having a first hole, a second section having a second hole, said first and second holes shaped and dimensioned to receive the lever portion and the shank portion of the lever-type door handle. The body further includes a bendable joint disposed between the first section and the second section so that the first and second sections may be bent toward each other. The bendable joint is resilient so that when the first and second sections are bent toward each other and released, the first and second sections are resiliently urged away from each other. When the body is installed on the shank portion of the lever-type door handle with the first and second holes receiving the shank portion, the first and second sections are urged away from each other in opposite directions along the shank portion, wherein the first section abuts the door and the second section abuts the lever portion of the door handle.

In accordance with an important aspect of the invention, when the first and second sections are bent together, the first and second holes reside in substantially aligned relationship so that the holes may simultaneously receive the lever and shank portions of the lever-type door handle.

In accordance with an important feature of the invention, the body has a second bendable joint disposed on the opposite side of the second section from the first bendable joint.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of a prior art lever-type door handle;

FIG. 2 is a front elevation view of a prior art door hanger;

FIG. 5 is a front elevation view of a hanger for a lever-type door handle in accordance with the present invention;

FIG. 6 is a side elevation view of the hanger;

FIG. 7 is a bent side elevation view of the hanger;

DETAILED DESCRIPTION OF THE INVENTION

Figure 3:
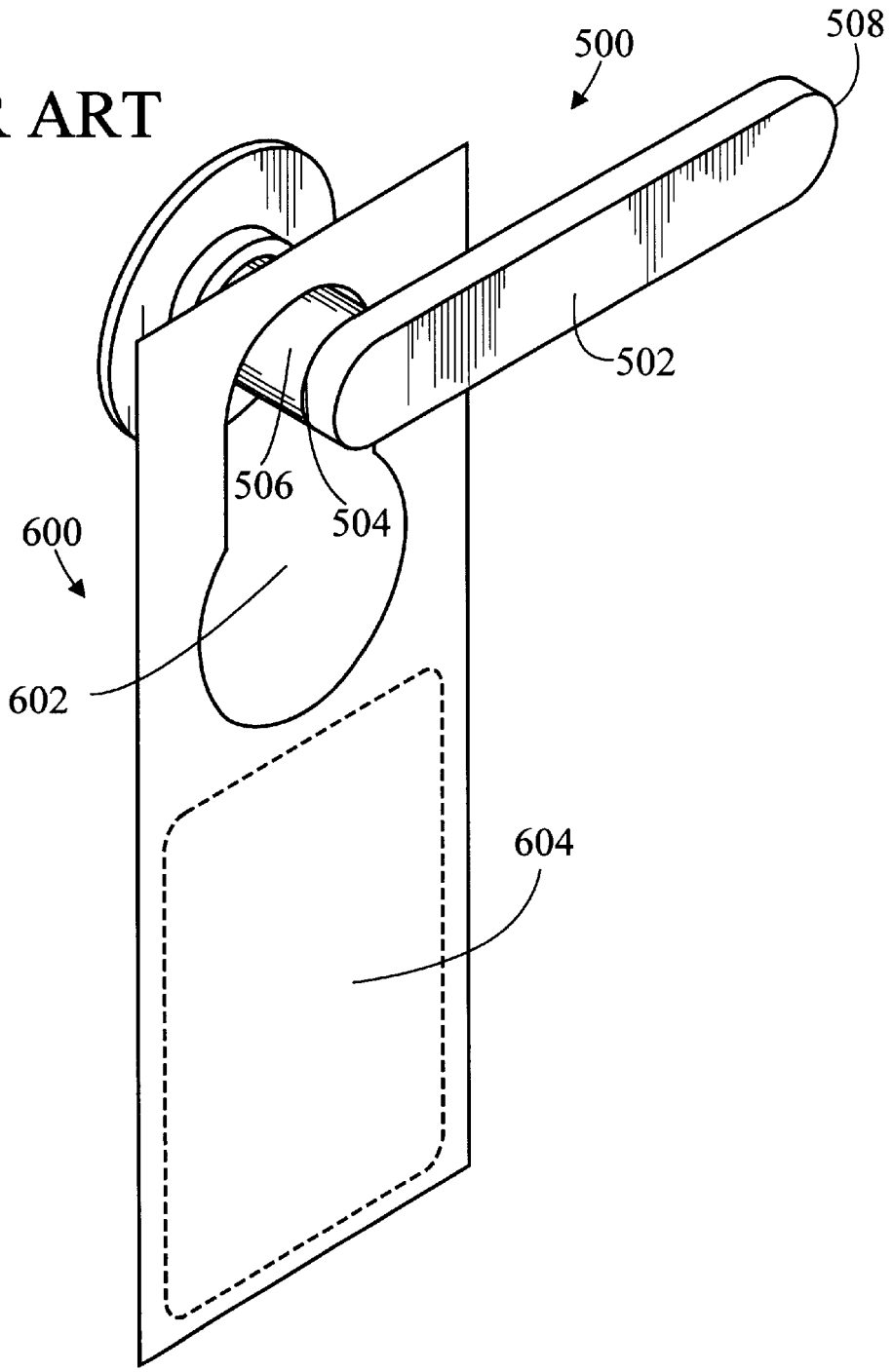
Fig. 3 PRIOR ART
FIG. 3 is a perspective view of the door hanger installed on the lever-type door handle.

Referring initially to FIG. 1, there is illustrated a perspective view of a prior art lever-type door handle 500. Lever-type door handle 500 has a lever portion 502 connected at a junction 504 to a substantially perpendicular shank portion 506. Lever portion 502 has an open end 508 opposite from shank portion 506.

Now referring to FIG. 2, there is illustrated a front elevation view of a prior art door hanger 600. Door hanger 600 is typically a thin body having a hole 602 to receive a door handle 500, and indicia 604 disposed on both sides containing various instructional information. Door hanger 600 is placed on door handle 500 to convey instructions to the cleaning staff of a boarding establishment. Such instructions typically include "DO NOT DISTURB", and "PLEASE CLEAN ROOM", disposed on opposite sides of door hanger 600.

FIG. 3 is a perspective view of door hanger 600 installed on lever-type door handle 500. Hanger 600 hangs upon shank portion 506.

Figure 4:
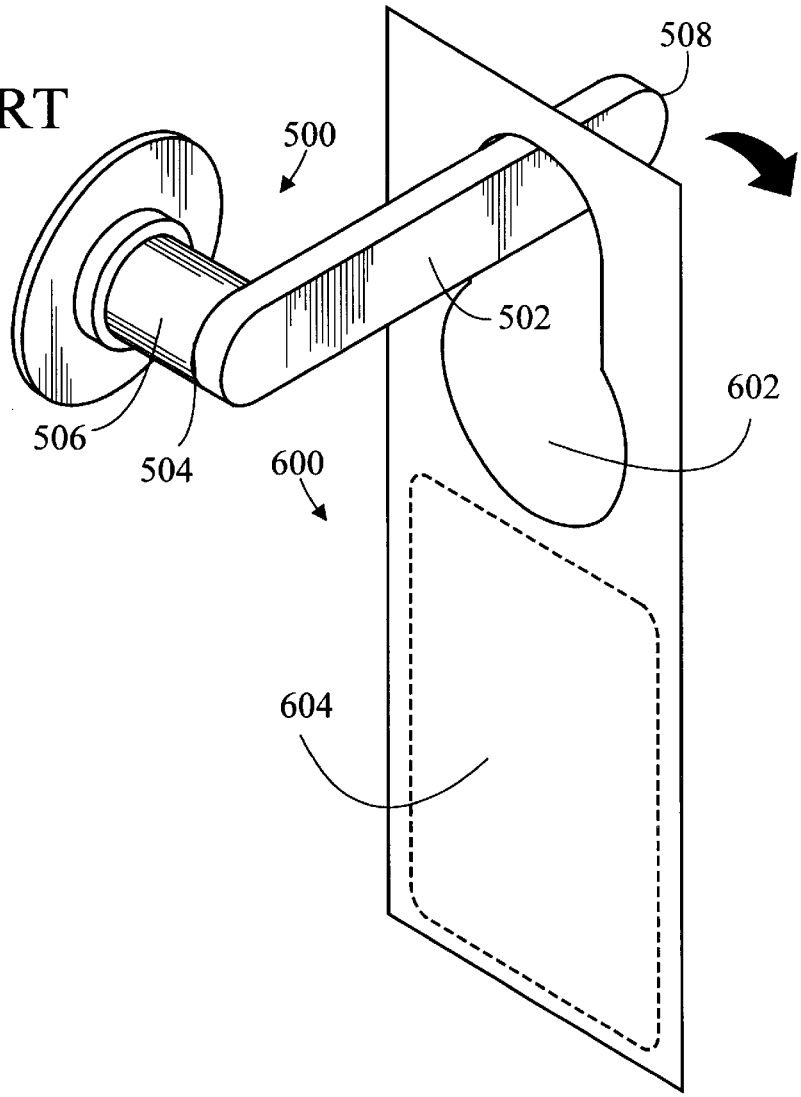
Fig. 4 PRIOR ART
FIG. 4 is a perspective view of the lever-type door handle and hanger when the door is open and closed.

FIG. 4 is a perspective view of lever-type door handle 500 and hanger 600 when the door is open and closed. The movement of the door can cause hanger 600 to migrate from shank portion 506, around junction 504, along lever portion 502, and fall off end 508.

Now referring to FIGS. 5–7, there are illustrated front elevation, side elevation, and bent side elevation views of a hanger for a lever-type door handle in accordance with the present invention, generally designated as 20. FIGS. 5 and 6 show hanger 20 in an unfolded state, and FIG. 7 shows hanger 20 in a folded state. Hanger 20 includes a body 22 having a first section 24 having a first hole 26, a second section 28 having a second hole 30, the first 26 and second 30 holes are shaped and dimensioned to receive the lever portion 502 and the shank portion 506 of lever-type door handle 500 (refer to FIG. 1). In the shown preferred embodiment body 22 has a first end 21, and the first section 24 is disposed at first end 21. Body further has a bendable joint 32 disposed between the first section 24 and second section 28 so that first 24 and second 28 sections may be bent toward each other in directions 34 and 36. Bendable joint 32 is resilient so that when first 24 and second 28 sections are bent toward each other and then released, first 24 and second 28 sections are resiliently urged away from each other in opposite directions 38 and 40. When body 22 is installed on the shank portion 506 of the lever-type door handle 500 with first 26 and second 30 holes receiving the shank portion 506, the first 24 and second 28 sections are urged away from each other in opposite directions along the shank 506 (refer also to FIGS. 9 and 11).

Body 22 has a first side 23 and an opposite second side 25, indicia (dashed area) being disposed on at least one first side 23 and second side 25. Body 22 also has a second bendable joint 42 disposed on the opposite side of second section 28 from first bendable joint 32. As is depicted in FIGS. 7–11, second bendable joint 42 permits the lower portion of body 22 to hang vertically when hanger 20 is installed on shank portion 506 of lever-type door handle 500. In a preferred embodiment, body 22 is fabricated from a sheet of paper, coated paper, or a polymer.

Figure 8:
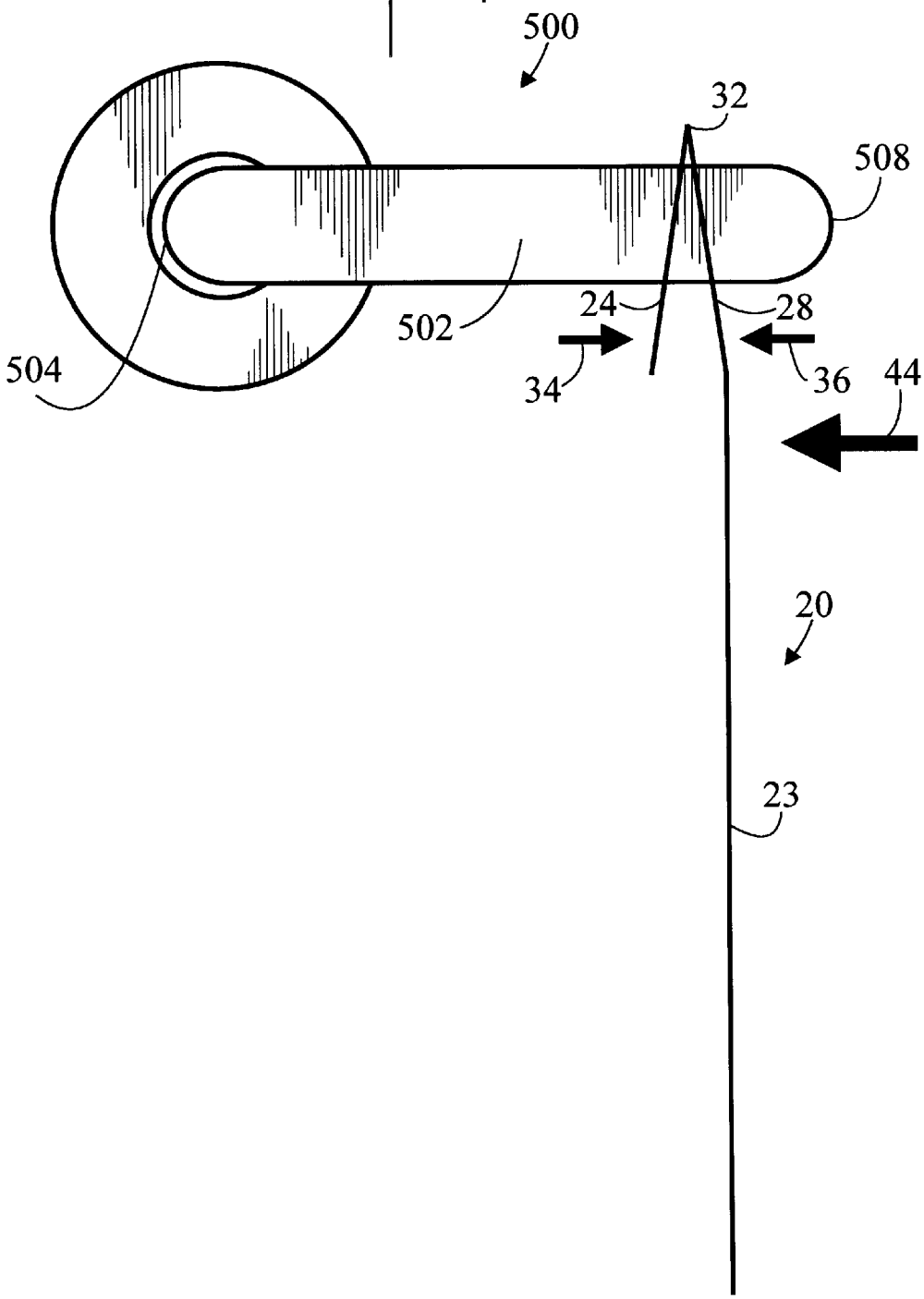
FIG. 8 is a front elevation view of the hanger being installed on the lever-type door handle.

FIG. 8 is a front elevation view of hanger 20 being installed on lever-type door handle 500. First section 24 has been bent toward second section 28 so that first 26 and second 30 holes are substantially aligned. This allows both holes 26 and 30 to receive open end 508 of lever portion 502. Hanger 20 is then slide along lever portion 502 in direction 44, around junction 504, and along shank portion 506 until both first 26 and second 30 holes receive shank portion 506 (refer also to FIG. 9).

Figures 9, 10:
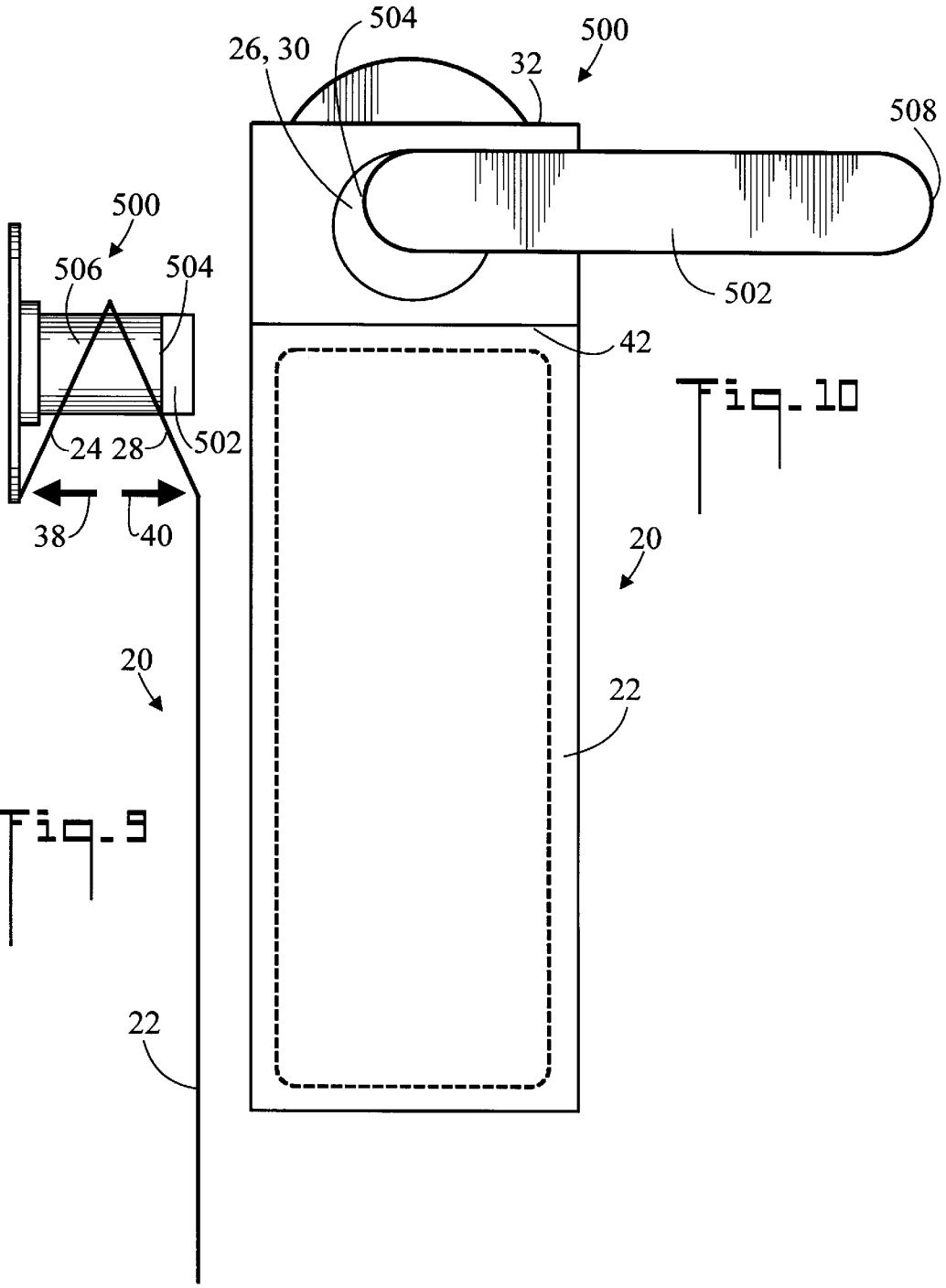
FIG. 9 is a side elevation view of the hanger installed on the shank portion of the lever-type door handle.
FIG. 10 is a front elevation view of the hanger installed on the shank portion of the lever-type door handle.

FIGS. 9 and 10 are side and front elevation views respectively of hanger 20 installed on shank portion 506 of lever-type door handle 500. When body 22 is installed on the shank portion 506 of the lever-type door handle 500 with first 26 and second 30 holes receiving the shank portion 506, the first 24 and second 28 sections are urged away from each other in opposite directions 38 and 40 along the shank 506. In this manner, second section 28 presses against lever portion 502, and first 24 and second 28 sections form an expanded structure which cannot travel around junction 504. Hanger 20 is therefore not susceptible to the movement of the door, and will remain fixedly in place even if the door is violently opened and closed. It is noted that when first 24 and second 28 sections are bent together, first 26 and second 30 holes reside in substantially aligned relationship, and can therefore easily be moved along lever portion 502, around junction 504, and along shank portion 506 (refer to FIG. 12).

Figure 11:
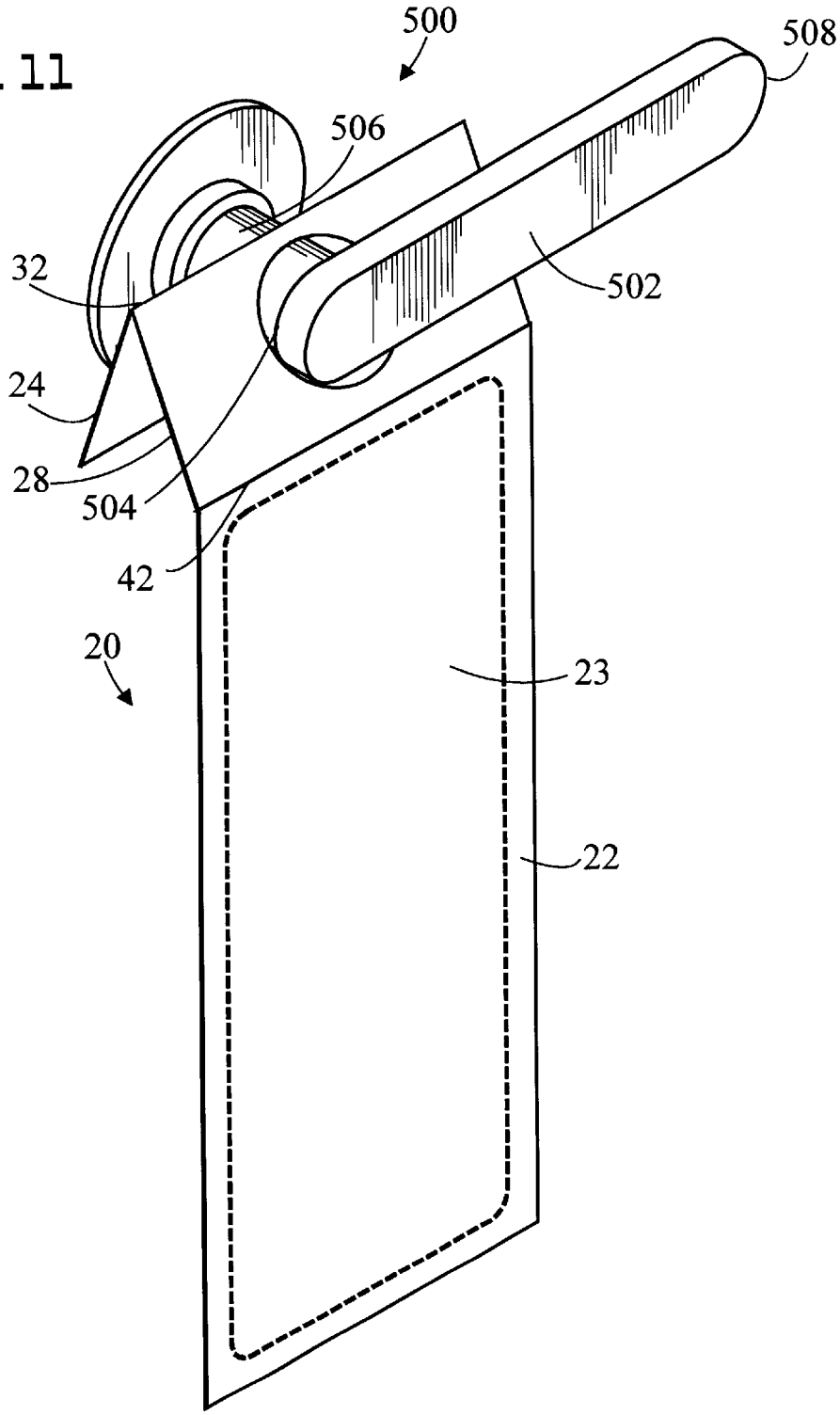
FIG. 11 is a perspective view of the hanger on the lever-type door handle.

FIG. 11 is a perspective view of hanger 20 installed on lever-type door handle 500.

Figures 12, 13:
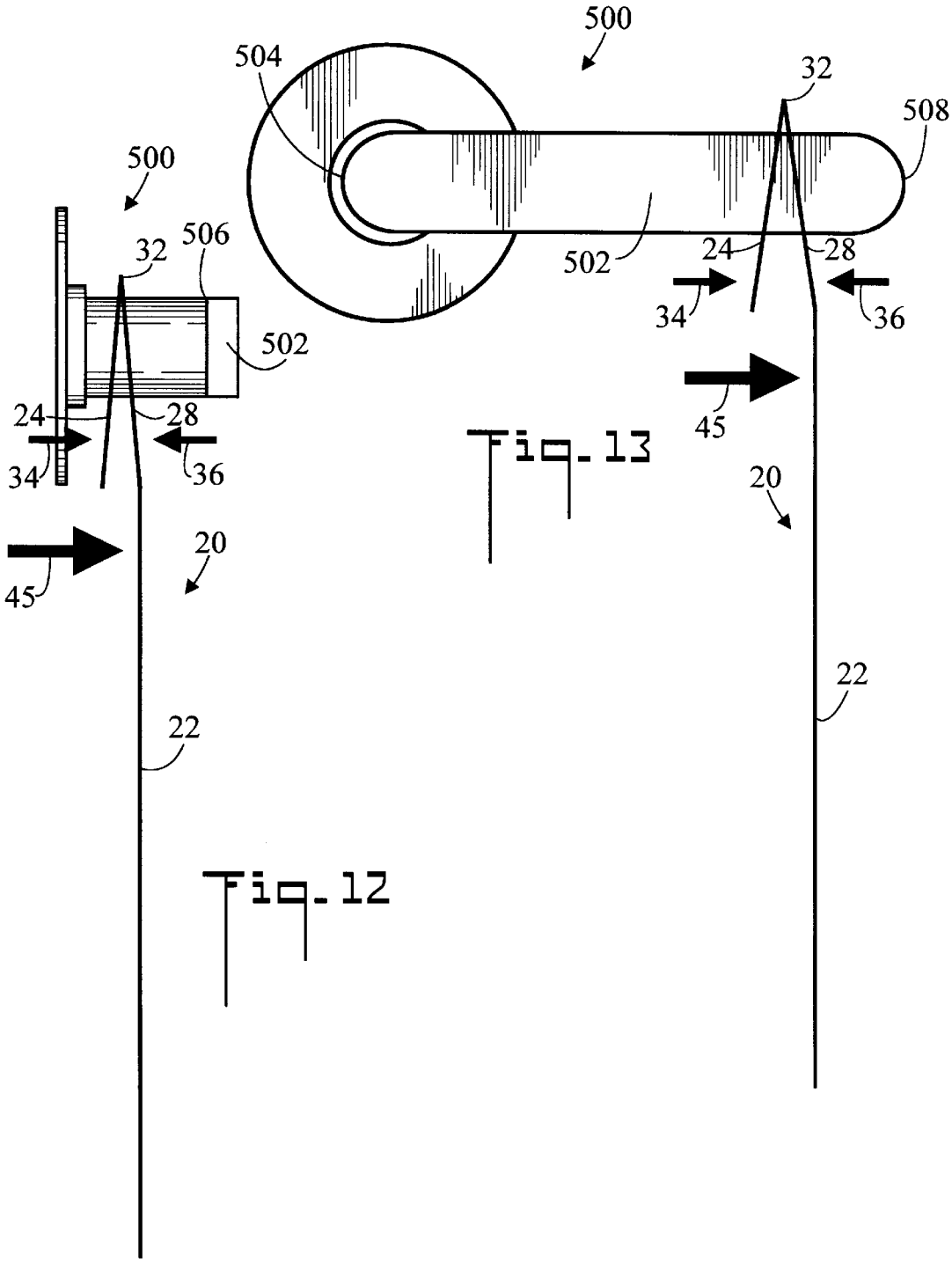
FIG. 12 is a side elevation view of the hanger being removed from the lever-type door handle.
FIG. 13 is a front elevation view of the hanger being removed from the lever-type door handle.

FIG. 12 is a side elevation view of hanger 20 being removed from lever-type door handle 500. First 24 and second 28 sections are bent toward each other in directions 34 and 36. Hanger 20 is then removed by sliding hanger 20 along shank portion 506 in direction 45, around junction 504, and along lever portion 502 until hanger 20 is off of lever-type door handle 500 (also refer to FIG. 13).

FIG. 13 is a front elevation view of hanger 20 being removed from lever-type door handle 500. Hanger 20 is moved along lever portion 502 in direction 45 until it becomes disengaged from end 508.

Figure 14:
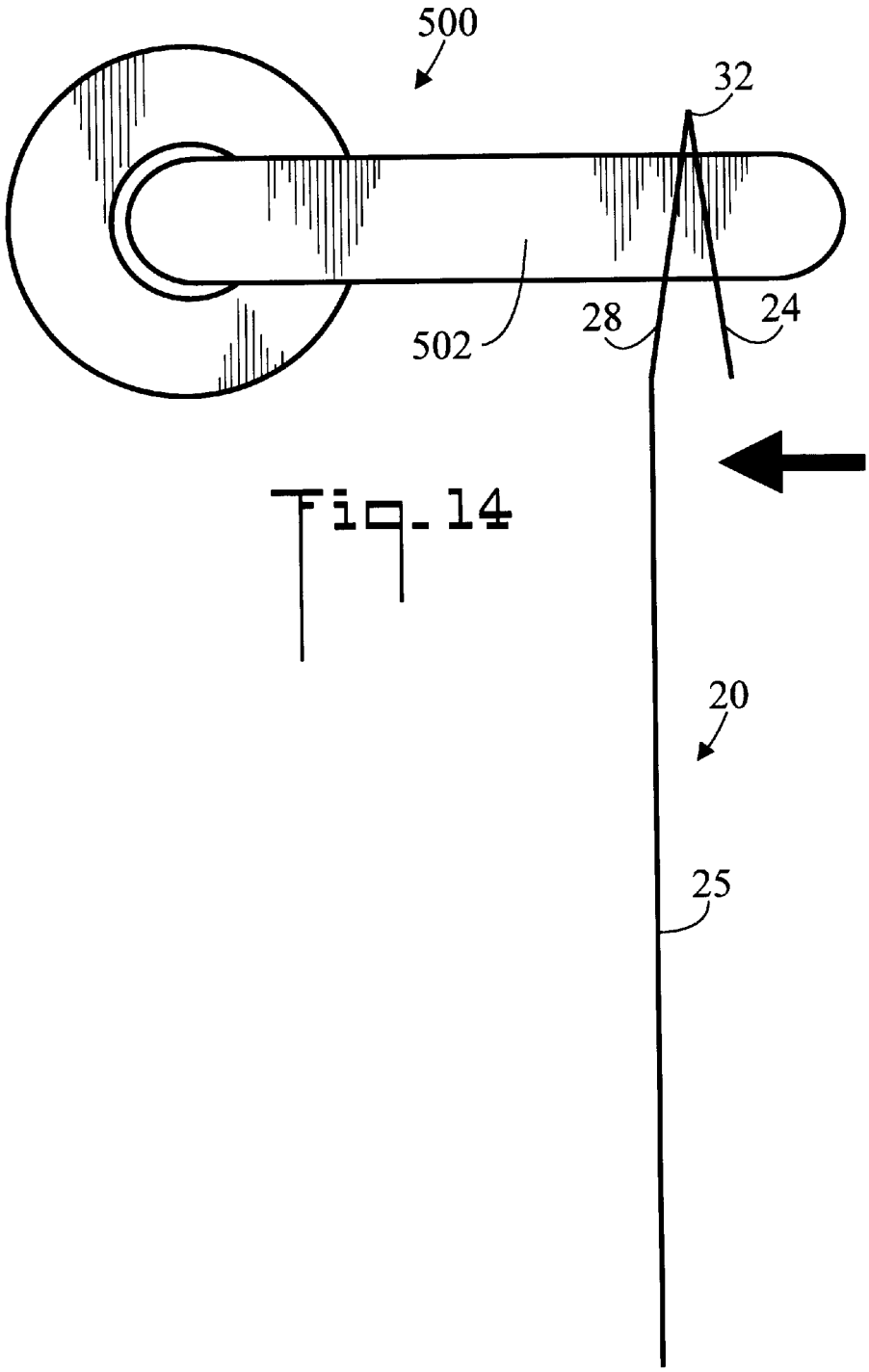
FIG. 14 is a front elevation view of the hanger being installed on the lever-type door handle in an opposite direction.

FIG. 14 is a front elevation view of hanger 20 being installed on lever-type door handle 500 in an opposite direction. In this embodiment hanger 20 is reversed so that the indicia disposed upon the second side 25 of body 22 will be visible when hanger 20 is installed.

Figure 15:
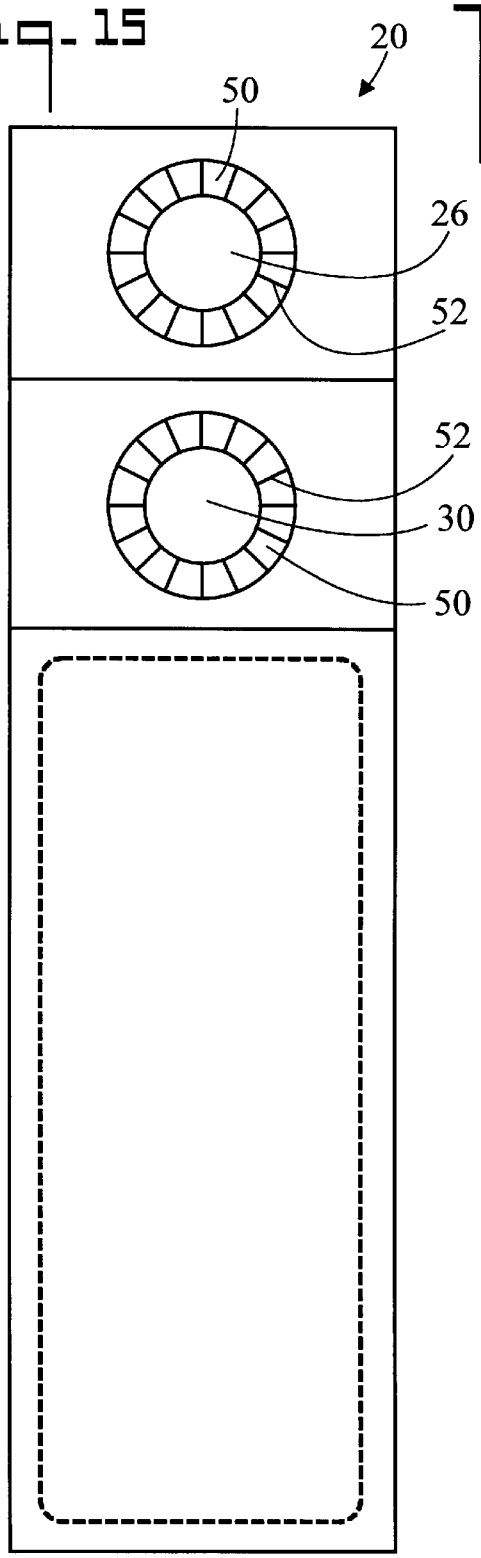
FIG. 15 is a front elevation view of a second embodiment of the hanger.

FIG. 15 is a front elevation view of a second embodiment of hanger 20. In this embodiment first 26 and second 30 holes each having a perimeter which includes a plurality of radial fingers 50. Fingers 50 are fashioned by a plurality of slits 52. Fingers 50 serve to better hold hanger 20 in place on lever-type door handle 500.

Figure 16:
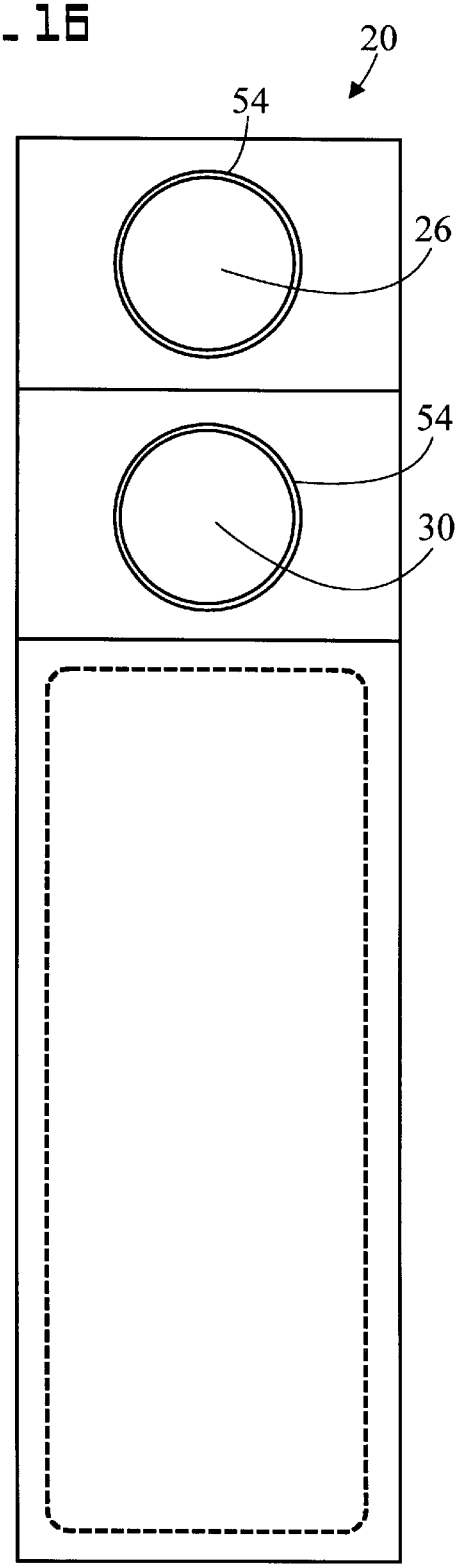
FIG. 16 is a front elevation view of a third embodiment of the hanger.

FIG. 16 is a front elevation view of a third embodiment of hanger 20. In this embodiment first 26 and second 30 holes each have a perimeter which includes a strengthening grommet 54.

In terms of use, a method for conveying information by placing a hanger upon a door handle, comprising:

(1) providing a lever-type door handle 500 having a lever portion 502 connected at a junction 504 to a substantially perpendicular shank portion 506, said the portion 502 having an open end 508 opposite from the shank portion 506;

(2) providing a hanger 20 for the lever-type door handle 500, the hanger 20 including:

a body 22 having a first section 24 having a first hole 24, a second section 28 having a second hole 30, the first 24 and second 28 holes shaped and dimensioned to receive the lever portion 502 and the shank portion 506 of the lever-type door handle 500;

the body further having a bendable joint 32 disposed between the first section 24 and the second section 28 so that the first 24 and second 28 sections may be bent toward each other;

the bendable joint 32 being resilient so that when the first 24 and second 28 sections are bent toward each other the first 24 and second 28 sections are resiliently urged away from each other; and, the body 22 having a first side 23 and an opposite second side 25, indicia disposed on at least one of the first side 23 and the second side 25;

(3) bending the first section 24 toward the second section 28 so that first 26 and second 30 holes are substantially aligned;

(4) causing the first 26 and second 30 holes to receive the open end 508 of the lever portion 502;

(5) sliding the hanger 20 along the lever portion 502, around junction 504, and along shank portion 506 until both the first 26 and second 30 holes receive shank portion 506; and, (6) releasing hanger 20 and observing that first 24 and second 28 sections are urged away from each other in opposite directions along shank portion 506.

The method further includes:

(7) bending the first section 24 toward the second section 28; and, (8) removing hanger 20 from the lever-type door handle 500 by sliding hanger 20 along shank portion 506, around junction 504, and along lever portion 502 until hanger 20 is off of lever-type door handle 500.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An improved hanger in combination with a door having a lever door handle, comprising:

a door having a lever door handle, said lever door handle having a lever portion connected to a substantially perpendicular horizontal shank portion;

a hanger including;

a body having a first section having a first hole, a second section having a second hole, said first and second holes shaped and dimensioned to receive said lever portion and said shank portion of said lever door handle;

said body further having a bendable joint disposed between said first section and said second section so that said first and second sections may be bent toward each other;

said bendable joint being resilient so that when said first and second sections are bent toward each other and released, said first and second sections are resiliently urged away from each other;

so that when said body is installed on said shank portion of said lever door handle with said first and second holes receiving said shank portion, said first and second sections are urged away from each other in opposite directions along said shank portion, wherein one of said first section and said second section is forced into contact with a portion of said lever door handle which is mounted to said door, and the other of said first section and said second section is forced into contact with said lever portion, and wherein said hanger is supported by said horizontal shank portion of said lever door handle;

wherein when said first and second sections are bent together, said first and second holes reside in substantially aligned relationship;

said body having a second bendable joint disposed on the opposite side of said second section from said first bendable joint, so that when a said hanger is installed on said lever door handle a lower portion of said body hangs down below said lever door handle in a substantially vertical orientation; and, indicia disposed upon said lower portion wherein when said hanger is installed on said lever door handle said indicia resides below said lever door handle.

2. A hanger according to claim 1, further including:

said body having a first end, said first section being disposed at said first end;

said body having a first side and an opposite second side, different said indicia disposed on said first side and said second side, so that said hanger may be selectively placed on said lever door handle to display said indicia of said first side or said indicia of said second side;

said first hole defining a first edge, and said second hole defining a second edge; and, wherein when said hanger is installed on said lever door handle, both said first edge and said second edge rest upon said shank portion of said lever door handle; and, wherein when said hanger is installed on said lever door handle said first and second sections forming substantially equal and opposite angles with said shank portion of said lever door handle.

3. A method for conveying information by placing a hanger upon a door handle, comprising:

(1) providing a lever door handle having a lever portion connected at a junction to a substantially perpendicular shank portion, said lever portion having an open end opposite from said shank portion;

(2) providing a hanger for said lever door handle, said hanger including:

a body having a first section having a first hole, a second section having a second hole, said first and second holes shaped and dimensioned to receive said lever portion and said shank portion of said door handle;

said body further having a bendable joint disposed between said first section and said second section so that said first and second sections may be bent toward each other;

said bendable joint being resilient so that when said first and second sections are bent toward each other and released, said first and second sections are resiliently urged away from each other;

said body having a first side and an opposite second side, different indicia disposed on said first side and said second side, so that said hanger may be selectively placed on said lever door handle to display said indicia of said first side or said indicia of said second side; and, said first hole defining a first edge, and said second hole defining a second edge;

(3) bending said first section toward said second section so that said first and second holes are substantially aligned;

(4) causing said first and second holes to receive said open end of said lever portion, wherein said lever portion is first received by said first hole and then received by said second hole;

(5) sliding said hanger along said lever portion, around said junction, and along said shank portion until both said first and second holes receive said shank portion; and, (6) releasing said hanger and observing that said first and second sections are urged away from each other in opposite directions along said shank portion, wherein both said first edge and said second edge rest upon said shank portion of said lever door handle.

4. The method of claim 3, further including:

(7) bending said first section toward said second section;

(8) removing said hanger from said lever door handle by sliding said hanger along said shank portion, around said junction, and along said lever portion until said hanger is off of said lever door handle;

(9) bending said first section toward said second section so that said first and second holes are substantially aligned;

(10) causing said first and second holes to receive said open end of said lever portion, wherein said lever portion is first received by said second hole and then received by said first hole;

(11) sliding said hanger along said lever portion, around said junction, and along said shank portion until both said first and second holes receive said shank portion; and,

(12) releasing said hanger and observing that said first and second sections are urged away from each other in opposite directions along said shank portion, wherein both said first edge and said second edge rest upon said shank portion of said lever door handle.

* * * * *